United States Patent [19]

Iizuka et al.

[11] 4,379,387

[45] Apr. 12, 1983

[54] CYLINDER CONTROL SYSTEM FOR MULTICYLINDER COMBUSTION ENGINE

[75] Inventors: Haruhiko Iizuka; Fukashi Sugasawa, both of Yokohama, Japan

[73] Assignee: Nissan Motor Company, Limited, Yokohama, Japan

[21] Appl. No.: 96,460

[22] Filed: Nov. 21, 1979

[30] Foreign Application Priority Data

Dec. 6, 1978 [JP] Japan ..... 53-151444

[51] Int. Cl.[3] ..... F01N 3/20; F02D 17/00

[52] U.S. Cl. ..... 60/277; 60/285; 123/198 F

[58] Field of Search ..... 60/277, 285; 123/198 F

[56] References Cited

U.S. PATENT DOCUMENTS

| | | | |
|---|---|---|---|
| 3,807,172 | 4/1974 | Masaki | 60/285 |
| 3,851,469 | 12/1974 | Eichler | 60/277 |
| 3,916,622 | 11/1975 | Gospodar | 60/277 |
| 3,955,363 | 5/1976 | Manderscheid | 60/277 |
| 4,007,589 | 2/1977 | Neidhard | 60/277 |
| 4,023,358 | 5/1977 | Maurer | 60/277 |
| 4,030,292 | 6/1977 | Masaki | 60/285 |
| 4,051,672 | 10/1977 | Masaki | 60/277 |
| 4,134,261 | 1/1979 | Iizuka | 60/277 |

FOREIGN PATENT DOCUMENTS 2128988 1/1973 Fed. Rep. of Germany .

*Primary Examiner*—Douglas Hart

*Attorney, Agent, or Firm*—Schwartz, Jeffery, Schwaab, Mack, Blumenthal & Koch

[57] ABSTRACT

Disclosed is a cylinder control system for a multicylinder internal combustion engine equipped with an exhaust gas purification device. This system has a valve control circuit which controls the number of fuel injection valves opened and closed, according to the load conditions of the engine. A detector is provided for determining the temperature in the exhaust gas purification device to generate a signal indicative of the temperature. A comparator compares the temperature signal with a reference value to generate, for the valve control circuit, a second signal indicative of whether the determined temperature is higher than a predetermined value. When the determined temperature is higher than the predetermined value, the second signal causes the valve control circuit to close the fuel injection valve or valves which thus far have been opened.

6 Claims, 2 Drawing Figures

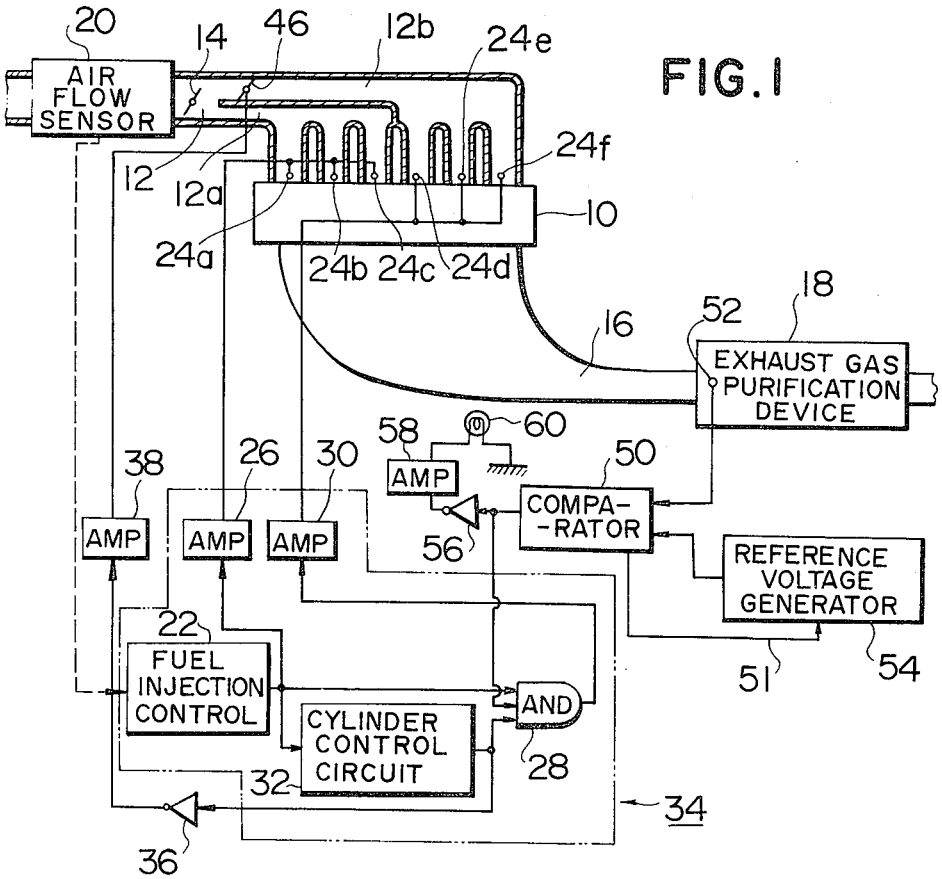
FIG. 1
FIG. 2
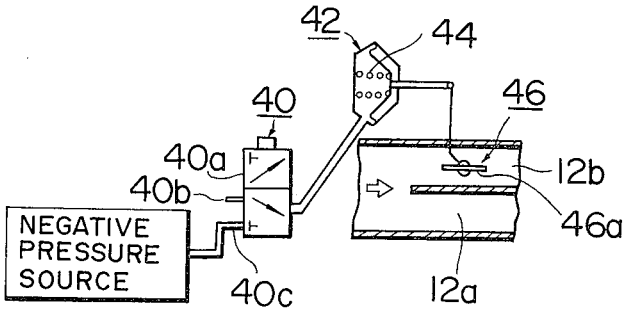

CYLINDER CONTROL SYSTEM FOR MULTICYLINDER COMBUSTION ENGINE

BACKGROUND OF THE INVENTION

The present invention relates to a cylinder control system for multicylinder internal combustion engines, and more particularly to improvements to a cylinder control system for a multicylinder internal combustion engine having an exhaust gas purification device and a plurality of fuel injection valves for injecting fuel into the cylinders of the engine.

Generally, operation of an internal combustion engine under a high load results in high fuel efficiency. Thus a cylinder control system for multicylinder internal combustion engines is known, by which, while the engine load is low, certain cylinders are not supplied with fuel, and the supply to the remaining working cylinders is increased by a corresponding amount so as to operate the engine in the range of high efficiency of fuel combustion.

If such a cylinder control system is provided in a fuel injection type multicylinder gasoline engine, certain cylinders to which the fuel supply is interrupted while the engine load is light will take in fresh air and discharge it, as is, into the exhaust passage. Accordingly, if a catalyst device is provided in the exhaust gas system, the cold air now discharged will lower the temperature of the catalyst and therefore the efficiency of purifying the exhaust gas by the catalyst, or the efficiency of reducing $NO_x$ when the catalyst is a three-way catalyst.

In view of this, we have proposed a device in which the intake passages to some of the cylinders, for example three predetermined cylinders of a 6-cylinder engine, to which fuel supply will be interrupted during light engine load, are separated from the intake passages of the remaining cylinders which will work at all times irrespective of the magnitude of the load. In addition, a valve is provided in the intake passage of the cylinders to which the fuel supply will be interrupted which is operable to close the intake passage so unused air does not flow into the exhaust gas passage while only the certain cylinders are being operated. (see Japanese Utility Model registration application 159832/1977.) This device prevents lowering of the temperature of the catalyst and therefore maintains the standard of exhaust gas purification.

If the valve does not operate, and more particularly if it remains closed or only partially open for some reason when it should be fully opened by an instruction to operate all the cylinders when the engine load is high, the cylinders concerned will not be supplied with air or with only insubstantial amounts of air but will be supplied with a normal amount of fuel by injection. Thus, the fuel will not be properly combusted but will be discharged from the cylinders thereby lowering the efficiency of fuel combustion and worsening the discharge of exhaust gases.

Most of the fuel injected into the cylinders into which air is not being properly supplied, may flow into the exhaust passage under the effect of the pulsations caused by the difference between the timings of injection of fuel into these cylinders, and further can be carried into the catalyst by the exhaust gas from the working cylinders. If the fuel thus discharged should be burned in a post-treatment device such as a catalyst device (reactor), the device will be burnt and its lifetime will be shortened.

SUMMARY OF THE INVENTION

It is therefore an object of the present invention to provide a cylinder control system for a multicylinder internal combustion engine having an exhaust gas purification device and a plurality of fuel injection valves for the injection of fuel into the cylinders of the engine, which stops the fuel supply to certain cylinders if the temperature of the exhaust gas purification device is equal to, or higher than, a predetermined value.

Another object of the present invention is to provide a cylinder control system of the above type which carries out an efficient discharge of the exhaust gas and an efficient combustion of fuel.

Still another object of the present invention is to provide a cylinder control system of the above type which is durable and reliable.

According to the present invention, there is provided a cylinder control system for a multicylinder internal combustion engine having an exhaust gas purification device and a plurality of fuel injection valves for injecting fuel into the cylinders of the engine, the cylinders being formed in at least two groups, each of which having at least one fuel injection valve controlled independently of any fuel injection valves in other cylinder groups and having a throttle valve controlling the air supply to a group of cylinders adopted to have their fuel supply interrupted during light engine loads. The control system comprises:

(a) a valve control circuit which controls the number of fuel injection valves opened and closed, according to the load conditions of the engine;

(b) a detector for determining the temperature in said exhaust gas purification device to generate a first signal indicative of the temperature; and (c) a comparator for comparing the first signal with a reference value to generate to the valve control circuit a second signal indicative of whether the temperature represented by the first signal is equal to, or higher than, a predetermined value whereby, when the second signal indicates that the determined temperature is equal to, or higher than, the predetermined value, the valve control circuit closes the fuel injection valve or valves which thus far have been opened and thus prevents fuel from being injected into the corresponding cylinder or cylinders.

Other objects, features and advantages of the present invention will become apparent to those skilled in the art from the following description, when taken in conjunction with the accompanying drawings.

BRIEF DESCRIPTION OF THE DRAWINGS

The accompanying drawings should not be taken as limiting the present invention in any way, but are given for the purposes of illustration only. In the drawings:

FIG. 1 shows a schematic diagram of a preferred embodiment of a cylinder control system according to the present invention, associated with a multicylinder internal combustion engine; and FIG. 2 shows across-sectional view of an air shut-off valve with its associated control means, to be used in the FIG. 1 embodiment.

DETAILED DESCRIPTION OF THE INVENTION

Referring to FIG. 1 of the accompanying drawings, there is shown a preferred embodiment of a cylinder control system according to the present invention, associated with a multicylinder internal combustion engine.

The engine, generally denoted by reference numeral 10, includes six cylinders. It should be understood that engines having more or less than six cylinders also fall within the scope of the present invention. An air intake passage 12 to the engine is, downstream of a throttle valve 14, separated into two passages 12*a* and 12*b* supplying the three left-hand cylinders (not shown) in the engine, as viewed in FIG. 1, and the three right-hand cylinders (not shown), respectively. An exhaust passage 16 is common to all the cylinders and includes an exhaust gas purification device 18 which may include an oxidation catalyst, a three-way catalyst, a thermal reactor, or the like.

An intake air flow sensor 20 is provided upstream of the throttle 14 and generates a signal indicating the amount of intake air supplied to the engine 10 to a fuel injection control circuit 22 which then provides a fuel injection pulse signal, having a pulse width controlled by the signal from the sensor 20, to fuel injections valves 24*a*, 24*b*, 24*c*, 24*d*, 24*e*, 24*f* provided for the six cylinders, respectively, so as to control the amounts of injection fuel from the respective fuel injection valves. The signal from the circuit 22 may have a pulse width directly proportional to the magnitude of the flow rate of the intake air and have a predetermined pulse repetition frequency.

The pulse signal from the fuel injection control circuit 22 is provided through an amplifier 26 to fuel injection valves 24*a*, 24*b*, 24*c* for the left-hand three cylinders and, on the other hand, through an AND gate 28 and an amplifier 30 to the injection valves 24*d*, 24*e*, 24*f*. Accordingly, only when the AND gate 28 is open, are all the fuel injection valves allowed to inject fuel. The AND gate 28 opens when the output of a cylinder control circuit 32 and the output of a comparator 52 (to be described in more detail hereinafter) depending on the temperature of the exhaust gas are both 1.

The cylinder control circuit 32 switches its output from 1 to 0 depending on the fuel injection pulse signal from the fuel injection control circuit 22 so as to shut off the supply of fuel to the left hand cylinders when the engine load is at or below a predetermined low level and the rate of engine revolution is greater than a predetermined low value.

Blocks 22 to 32 constitute a valve control circuit 34.

The output of the cylinder control circuit 32 is supplied through an inverter 36 and an amplifier 38 to an electromagnetic change-over valve. This valve, shown by 40 in FIG. 2, is a three-way valve which includes a spool 40*a* and controls the action of a diaphragm type drive device 42 which in turn includes a return spring 44 and controls a shut off valve 46 for the right-hand cylinders.

In order to operate all the cylinders, the valve member 46*a* connected to the diaphragm type drive device 42 must be completely open. On the other hand, in order to operate only certain of the cylinders, the drive device 42 must be supplied with a negative pressure so as to be closed. Thus, the change-over valve 40 is provided with an atmospheric air inlet 40*b* and a negative pressure inlet 40*c*.

The diaphragm type drive device 42 closes the valve member 46*a* completely by the action of return spring 44 when atmospheric pressure is introduced into the drive device 42.

The comparator, denoted by reference numeral 50 in FIG. 1, compares the output of a sensor or detector 52 which determines the temperature of the exhaust gas in the exhaust gas purification device 18, with the reference output of a reference voltage generator 54 corresponding to an abnormally high temperature setting point to provide an output 1 when the temperature of the exhaust gas is below a predetermined value, i.e. a normal value, and an output 0 when the temperature of the exhaust gas is above the predetermined value, i.e. abnormally high. Accordingly, when the temperature of the exhaust gas is in its normal range, the cylinder control circuit 32 controls the number of cylinders being operated, in accordance with the load requirements.

The comparator 50 provides an output through an inverter 56 and an amplifier 58 to an alarm device such as a visual or audible alarm 60 well known to those in the art. Accordingly, when the output of the comparaor 50 is 0 because the temperature of the exhaust gas is abnormally high, the AND gate 28 closes to force operation of only certain of the cylinders, i.e. to stop the supply of fuel to certain cylinders, and simultaneously operate the alarm 60. Thus, automatically the engine temperature should be reduced, but also the operator will be alerted, so that steps can be taken to find and eliminate the problem.

Additionally, this setting in response to an abnormal condition may be maintained by a conventional self-hold circuit (not shown) contained in the comparator, or alternatively by switching the output of the reference voltage generator 54 from a higher temperature setting to a lower temperature setting through a circuit 51 after the occurrence of an abnormally high temperature.

In operation, while the engine load is medium or high, i.e. all its cylinders are operating, the cylinder control circuit 32 output is 1. Accordingly, the fuel injection control circuit 22 provides a pulse signal through the AND gate 28 to the injection valves 24*d*, 24*e*, 24*f* for the right-hand cylinders so that the valves 24*d*, 24*e*, 24*f* inject fuel like the injection valves 24*a*, 24*b*, 24*c*.

At such a time, the output of the cylinder control circuit 32 is provided through the inverter 36 to the electro-magnetic change-over valve 46 so that it is switched to the atmospheric side thereby exerting the atmospheric pressure on the diaphragm type drive device 42. This causes the shut off valve device 46 to open the separation passage 12*b* completely.

When the engine load is lower than a predetermined level and the revolution rate of the engine is larger than a predetermined value, the output of the cylinder control circuit 32 is switched to 0. This causes the AND gate 28 to close to shut off the pulse signal to the fuel injection valves 24*d*, 24*e*, 24*f*. Simultaneously, the change-over valve 40 is switched to supply a negative pressure to the diaphragm type drive device 42 so as to close the shut off valve device completely. As a result, the supply of both air and fuel to the right-hand cylinders is stopped and the left-hand cylinders only are operated.

In this case, the total amount of intake air to the left-hand cylinders is the same as before. Accordingly, the amount of fuel injected should be twice as much as before. Thus, an adjustment is made to double the pulse width of the injection signal.

If the shut off valve device 46 should closed or only a little open, for any reason, even when the cylinder control circuit 32 has given the instruction to return from partial-cylinder operation to all-cylinder operation, the following sequence will occur. Normal fuel injection is restarted by the fuel injection valves 24*d*, 24*e*, 24*f*, however, without an adequate supply of air normal burning of fuel cannot be effected in the right-hand cylinders with the result that a large amount of unburned fuel will be discharged into the exhaust passage 16. This unburned fuel will burn in the exhaust gas purification device 18 thereby heating it to an abnormally high temperature.

When the comparator 52 determines such a rise in temperature through the temperature sensor 18, the output of the comparator is switched from 1 to 0 with the result that the AND gate 28 closes so as to shut off the supply of fuel to the injection valves 24*d*, 24*e*, 24*f* as well as to cause the advise device 60 to operate and alarm the operator of an abnormal condition.

Once the occurrence of an abnormal condition has been detected, the supply of fuel to the right-hand cylinders is immediately stopped so as to prevent a worsening of the situation.

The system according to the present invention can shut off the supply of fuel to the engine if the temperature of the exhaust gas has risen to an abnormally high value for some other reason, even though the shut off valve device 46 is adequately open. In this case, the outflow of air from the right-hand cylinders will serve to cool the exhaust gas purification device 18.

Therefore according to the present invention, if an oxygen sensor is provided in the exhaust gas passage in order to effect a feedback control of the ratio of air to fuel, its action may be suspended temporarily when the output of the comparator 50 is switched to 0.

Although, therefore, the present invention has been shown and described with respect to the preferred embodiment thereof, it is not intended to limit the invention to the precise form disclosed and obviously many modifications and variations are possible in light of the above teachings. For example, the alarm device is shown as a lamp, but may be any form of visual or audible alarm. Yet further variations and alterations of the form and the content of the present invention could be envisaged without departing from its scope or spirit; and therefore it is expressly desired that this scope should not be determind or limited in any way by any of the features of the drawings or of the embodiments which have been shown and described, which may be purely fortuitous; but only by the accompanying claims, which follow.

What is claimed is:

1. A cylinder control system for a multicylinder internal combustion engine with an exhaust gas purification device for purifying the exhaust from the cylinders, the cylinders forming at least a first and a second group of cylinders, each of the groups having at least one fuel injection valve controlled independently of the fuel injection valves for other groups, the air supply to the first group being controlled by a first throttle valve, the air supply to the second group being controlled by the first and second throttle valves, the cylinder control system comprising:

(a) air flow sensor means for measuring the air flow through the first throttle valve and generating an air flow signal indicative thereof;

(b) Fuel injection control circuit means responsive to said air flow signal to generate a fuel injection signal indicative of a quantity of fuel to be injected;

(c) cylinder control circuit means responsive to said fuel injection signal to generate a control signal when said fuel injection signal falls below a predetermined value, said second throttle responding to said control signal to interrupt the supply of air to the second group;

(d) detector means for sensing the temperature of the exhaust purification device and generating a first signal indicative thereof;

(e) comparator means for comparing said first signal to a first reference value representative of a predetermined temperature value above which the purification device may be damaged by heat and for generating a second signal when said first signal exceeds said first reference value; and (f) gate means responsive to said control signal and the absence of said second signal for gating said fuel injection signal to said at least one fuel injection valve of said second cylinder group.

2. A cylinder control system as claimed in claim 1, wherein said comparator continues to generate the second signal once the comparator has generated said second signal.

3. A cylinder control system as claimed in claim 1, wherein said system includes a reference voltage generator for generating saind first reference value, said reference voltage generator beng adapted to generate a second reference value lower than the first reference value after it has generated the first reference value, in order to hold said second signal.

4. A cylinder control system as claimed in claim 1, further including an alarm means responsive to the second signal to alert an operator to that condition.

5. A cylinder control system as claimed in claim 4, wherein said alarm means includes a visual alarm.

6. A cylinder control system as claimed in claim 4, wherein said alarm means includes an audible alarm.

* * * * *